US008863427B2

(12) United States Patent
Chiang

(10) Patent No.: US 8,863,427 B2
(45) Date of Patent: Oct. 21, 2014

(54) AUTOMATICALLY ADJUSTABLE COMB FOR A FIREARM

(71) Applicant: Grip Plus Inc, Menlo Park, CA (US)

(72) Inventor: Sai Ming Chiang, Redwood City, CA (US)

(73) Assignee: Grip Plus Inc, Menlo Park, CA (US)

( * ) Notice: Subject to any disclaimer, the term of this patent is extended or adjusted under 35 U.S.C. 154(b) by 146 days.

(21) Appl. No.: 13/683,335

(22) Filed: Nov. 21, 2012

(65) Prior Publication Data

US 2014/0137456 A1 May 22, 2014

(51) Int. Cl.
*F41C 23/00* (2006.01)
*F41C 23/14* (2006.01)

(52) U.S. Cl.
CPC ..... *F41C 23/14* (2013.01)
USPC ..... 42/73

(58) Field of Classification Search
USPC ..... 42/1.06, 71.01, 71.02, 72, 73, 74, 90
See application file for complete search history.

(56) References Cited

U.S. PATENT DOCUMENTS

| | | | | | |
|---|---|---|---|---|---|
| 56,506 | A * | 7/1866 | Jones | 42/73 |
| 717,011 | A * | 12/1902 | Marsland | 42/71.01 |
| 1,651,299 | A * | 11/1927 | Stansel | 42/73 |
| 5,235,764 | A * | 8/1993 | Perazzi | 42/73 |
| 5,392,553 | A * | 2/1995 | Carey | 42/73 |
| 5,933,997 | A * | 8/1999 | Barrett | 42/73 |
| 5,974,940 | A * | 11/1999 | Madni et al. | 89/41.17 |
| 6,032,397 | A * | 3/2000 | Iannetta | 42/73 |
| 7,418,797 | B1 * | 9/2008 | Crose | 42/74 |
| 8,453,365 | B1 * | 6/2013 | Ballard | 42/73 |
| 8,763,296 | B1 * | 7/2014 | Chvala | 42/73 |
| 2008/0028662 | A1 * | 2/2008 | Abraham et al. | 42/73 |
| 2008/0236017 | A1 * | 10/2008 | Fitzpatrick et al. | 42/73 |
| 2012/0030984 | A1 * | 2/2012 | Andersson | 42/75.03 |
| 2012/0036757 | A1 * | 2/2012 | Larue | 42/73 |
| 2014/0109453 | A1 * | 4/2014 | Paquette | 42/73 |

* cited by examiner

*Primary Examiner* — Gabriel Klein
(74) *Attorney, Agent, or Firm* — Parsons Behle & Latimer

(57) ABSTRACT

An automatically adjustable comb for a firearm that extends a predetermined distance from an initial position, flush with the top of a stock, when the firearm moves to a predetermined angular orientation. The automatic adjustable comb may include a detector that detects when the firearm and/or comb has moved to a predetermined angular orientation with respect to a horizontal orientation. The detector may actuate an actuator to extend the comb the predetermined distance from the initial position. The extension of the comb elevates the top of the comb with respect to the top of the stock. The user may be able to vary both the predetermined angular orientation and the predetermined distance. The detection device may detect when the firearm is lowered to a horizontal orientation from an elevated angular orientation causing the actuator to lower the comb so that it is flush with the stock of the firearm.

10 Claims, 3 Drawing Sheets

AUTOMATICALLY ADJUSTABLE COMB FOR A FIREARM

BACKGROUND

1. Field of the Disclosure

The embodiments described herein relate to a comb of a firearm that automatically adjusts the height of the comb relative to a stock based on the angular orientation of the firearm.

2. Description of the Related Art

Adjustable combs have been used in the butt stocks of firearms held against the shoulder of a shooter, particularly in the butt stock of shotguns. An adjustable comb may be created by cutting the comb from a butt stock and mounting the comb onto adjustable hardware. The comb and adjustable hardware are then mounted to the butt stock in the recess created by cutting the comb from the butt stock. The adjustable comb permits the shooter to manually move the comb up and down and sometimes even left and right.

The adjustable comb that is properly adjusted may position the shooter's eye straight along the barrel of the firearm. For example, when shooting at an elevated target it may be beneficial to raise the comb 0.25 to 0.375 inches. In a raised position, the shooter's cheek may rest against the raised comb to properly align the shooters eye down the barrel of the firearm to shoot the elevated target. When shooting at a non-elevated target with an elevated comb, the shooter has to compensate for the raised comb. To eliminate the need for compensation, the shooter could readjust the comb to the non-raised position prior to shooting the non-elevated target. However, such adjustments are not practical when shooting targets of differing elevations in rapid succession.

Conventional adjustable combs may be adjusted by changing or adjusting the hardware connected to the adjustable comb. For example, spacers may be added to raise up the comb and may be removed to lower the elevation of the comb. Typically, a user will need to use a tool such as a hex key to modify the adjustable comb. Other conventional adjustable combs use long set screws to raise or lower the height of the comb. The shooter uses a tool to tighten or loosen the set screws to adjust the height of the comb. Conventional manually adjustable combs cannot be adjusted on the fly. Instead, the manual adjustment of conventional adjustable combs requires the shooter to set the comb at a single height prior to shooting targets in rapid succession. The single height of the comb may require the shooter to compensate while shooting targets having differing heights. Thus, it would be beneficial to provide an adjustable comb that automatically adjusts on the fly.

SUMMARY

The present disclosure is directed to a comb for a firearm that adjusts on the fly automatically extending the comb to an elevated position when the firearm moves from a horizontal orientation to a predetermined elevated angular orientation. The comb may then be automatically retracted to an initial non-elevated position when the firearm from back to a horizontal orientation.

One embodiment of the present disclosure is an accessory for a firearm comprising a comb configured to be attached to a portion of a firearm and to be extended a predetermined distance from an initial position while attached to the firearm. The comb is configured to automatically extend the predetermined distance from the initial position when the comb moves from a first angular orientation to a second angular orientation. The first angular orientation may be a horizontal angular orientation and the second angular orientation may be at least fifteen degrees inclined above the horizontal orientation. The accessory may include a detector configured to detect the angular orientation of the comb. The detector may be a tilt switch, a motion sensor, or a computer connected to a control sensor. The detector may be configured to detect when the comb is at a second angular orientation, which is a predetermined inclination above a first angular orientation. The predetermined inclination may be at least fifteen degrees. The predetermined inclination may be adjustable.

The accessory may include an actuator connected to the comb. The actuator may be in communication with the detector. Upon detection of movement of the comb to a second angular orientation, the actuator may extend the comb a predetermined distance. The predetermined distance may be 0.375 inches. The predetermined distance may be adjustable. The actuator may be an earth magnet, an electromagnet, and a power source, wherein detection of the second angular orientation connects the power source to the electromagnet causing a repulsion between the earth magnet and the electromagnet to extend the comb a predetermined distance. The actuator may be a pneumatic air cylinder and an air supply, wherein detection of the second angular orientation connects the air source to the pneumatic air cylinder to extend the comb a predetermined distance. The actuator may be an electric motor and a power source, wherein detection of the second angular orientation connects the power source to the electric motor to actuate the motor to extend the comb a predetermined distance. The actuator may be a piezoelectric transducer and a power source, wherein detection of the second angular orientation connects the power source to the piezoelectric transducer to extend the comb a predetermined distance. The actuator may be a biased spring and a latch, wherein the detection of the second angular orientation actuates the latch to release the biased spring to extend the comb a predetermined distance.

The detector may be configured to detect that the angular orientation of the comb has moved from the second angular orientation to the first angular orientation and the actuator is configured to retract the comb the predetermined distance based on the detector detecting that the angular orientation of the comb has moved from the second angular orientation to the first angular orientation.

One embodiment of the present disclosure is a method of automatically adjusting the comb of a firearm comprising detecting the movement of a firearm from a predetermined first angular orientation to a predetermined second angular orientation and extending the comb a predetermined distance from an initial position upon detection of the movement to the second angular orientation. The method may include locking the comb at the predetermined distance. The method may include detecting a movement of the firearm from the second angular orientation back to the first angular orientation and retracting the comb the predetermined distance to the initial position upon detection of the movement back to the first angular orientation. The method may include locking the comb in the initial position. The method may include adjusting the predetermined distance. The method may include increasing the second predetermined angular orientation with respect to the predetermined first angular orientation. The method may include decreasing the second predetermined angular orientation with respect to the predetermined first angular orientation.

One embodiment of the disclosure is a system for automatically adjusting a comb of a firearm. The system comprising a stock connected to a firearm and a comb having a top surface positioned within a recess in a top surface of the stock. The system include a sensor configured to detect the angular orientation of the firearm and an actuator configured to extend the comb a predetermined distance from an initial position when the sensor detects that the firearm is orientation at a first predetermined angular orientation. The initial position of the top surface of the comb is flush with the top surface of the stock.

The predetermined distance may be 0.375 inches. The actuator may be configured to permit the predetermined distance to be varied. The system may include a switch that deactivates the sensor. The system may include a switch that locks the actuator. The sensor of the system may be a tilt switch, a motion sensor, or a computer connected to a control sensor.

The actuator may be an earth magnet, an electromagnet, and a power source, wherein detection of a predetermined angular orientation connects the power source to the electromagnet causing a repulsion between the earth magnet and the electromagnet to extend the comb a predetermined distance. The actuator may be a pneumatic air cylinder and an air supply, wherein detection of a predetermined angular orientation connects the air source to the pneumatic air cylinder to extend the comb a predetermined distance. The actuator may be an electric motor and a power source, wherein detection of a predetermined angular orientation connects the power source to the electric motor to actuate the motor to extend the comb a predetermined distance. The actuator may be a piezoelectric transducer and a power source, wherein detection of a predetermined angular orientation connects the power source to the piezoelectric transducer to extend the comb a predetermined distance. The actuator may be a biased spring and a latch, wherein the detection of a predetermined angular orientation actuates the latch to release the biased spring to extend the comb a predetermined distance.

Figure 1:
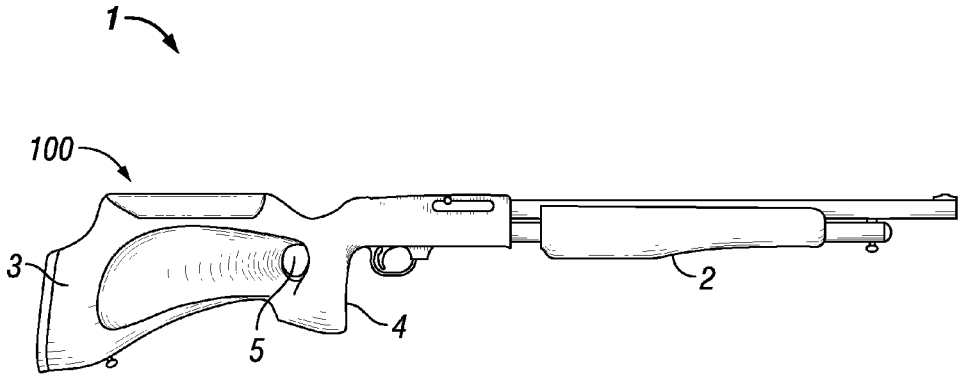
FIG. 1 shows a firearm that includes an embodiment of a automatically adjusting comb.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a firearm 1 that includes an embodiment of an automatically adjusting comb 100. The firearm 10 includes a stock 3, which may be referred to as a butt stock. The stock 3 may include a grip 4 and a thumbhole 5. The firearm may also include a forend stock 2 connected to the forward portion of the firearm 1. The configuration of the stock 3 with the grip 4 and thumbhole 5 is for illustrative purposes only. The automatic adjusting comb 100 may be used with various stocks 2 connected to a firearm 1 as would be appreciated by one of ordinary skill in the art having the benefit of this disclosure. For example, the stock 2 may include a pistol grip instead of the grip 4 and thumbhole 5 as shown. The automatically adjusting comb 100 may preferably by used in connection with a shotgun, but may be beneficial with any firearm that is positioned against the shoulder of a shooter.

FIG. 1 shows the comb 100 in a first or initial position in which the top surface 101 (shown in FIG. 2) of the comb 100 is flush with the top surface of the stock 3. When the firearm 1, and thus the comb 100, moves from a first angular orientation to a second angular orientation, the comb 100 automatically extends the comb a predetermined distance from an initial position. In the initial position the top surface 101 of the comb 100 is flush or level with the top surface of the stock 3. When the comb 100 is automatically extended, the top surface 101 of the comb 100 is elevated with respect to the top surface of the stock 3. The first angular orientation may be predetermined to be a horizontal orientation of the firearm and the second angular orientation may be predetermined to be a specific angular inclination above the horizontal orientation. For example, the second angular orientation may be preset to be twenty degrees above horizontal. This predetermined second angular orientation may be varied by the user of the automatic comb. Upon movement of the firearm 1 and/or comb 100 to twenty degrees above horizontal, the comb 100 automatically adjusts to raise or extend the top surface 101 of the comb 100 a predetermined distance above the top surface of the stock 3, as is discussed below in more detail. The predetermined distance may be set by the user of the automatic comb 100. For example, the user may adjust the automatic comb 100 to raise the top surface 101 to be 0.375 inches above the top surface of the stock 3.

Figure 2:
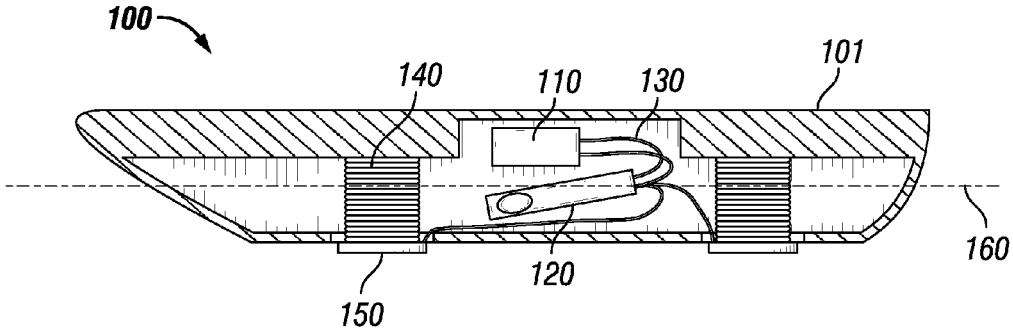
FIG. 2 shows one embodiment of an automatically adjusting comb at a horizontal angular orientation.

FIG. 2 shows one embodiment of an automatically adjusting comb 100 at first angular orientation, which in this instance is a horizontal angular orientation 160. The automatically adjusting comb 100 includes an actuator that raises the top surface 101 of the comb 100 when attached to the stock 3 of a firearm 1. The actuator may comprise a magnet 150 positioned adjacent to an electromagnet 140. The magnet 150 and electromagnet 140 may be connected to a post 145 (shown in FIG. 3) such that the electromagnet 140 may be able to move away or extend from the magnet 150 when actuated. Instead of a post 145, the magnet 150 and electromagnet 140 may be coupled in various ways that permit the movement of the two magnets 140, 150 away from each other when the actuator is actuated. The magnet 150 may be mounted to the stock 3 of the firearm 1 or may be mounted on a base plate that is connected to the stock 3 of the firearm 1.

The automatically adjusting comb 100 includes a detector that is used determine the angular orientation of the firearm 1 and/or automatically adjusting comb 100. The detector device may be a tilt switch 120 that closes upon the comb 100 being positioned at a predetermined angular orientation. Upon raising the firearm 1 and/or comb 100 to a predetermined angular orientation above a horizontal orientation 160, the tilt switch 120 closes connecting the electromagnet 140 to a power source such as a battery 110. Wires 130 may interconnect the battery 110, tilt switch 120, and the electromagnet 140. Upon connection of the electromagnet 140 to a power source 110, the electromagnet 140 creates a magnetic field which is repulsed by the magnetic field of the magnet 150. The repulsion between the electromagnet 140 and the magnet 150 causes the electromagnet 140 to move away from the magnet 150, as shown in FIG. 3, which extends the comb 100 a predetermined distance 190 from the stock 3.

Figure 3:
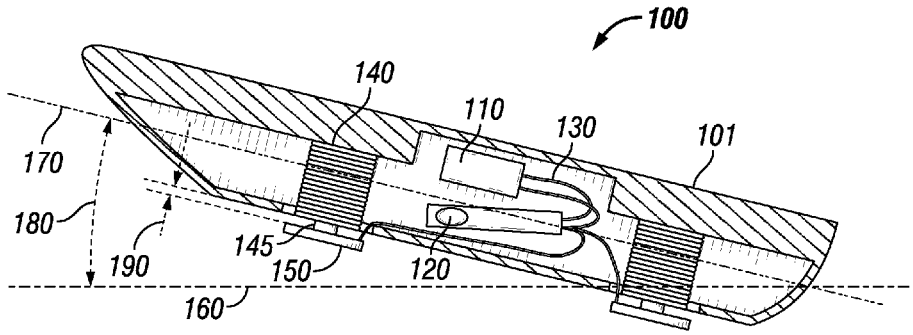
FIG. 3 shows the embodiment of an automatically adjusting comb of FIG. 2 at a predetermined angular orientation so that the adjustment device has actuated changing the height of the comb.

FIG. 3 shows the automatically adjusting comb 100 oriented at a second predetermined angular orientation 180 so that the actuator has actuated changing the height of the comb 100. The second predetermined angular orientation 180 may be selected to be twenty degrees above a horizontal orientation. For example, the central axis 170 of the comb 100 may be inclined to a preset degree 180 above a horizontal orientation 160 of the comb 100. The automatically adjustment comb 100 may be configured to permit a user to change the second predetermined angular orientation 180. For example, the user could lower the second predetermined angular orientation 180 to ten or fifteen degrees of inclination above horizontal or instead may want to increase the second predetermined angular orientation to twenty five or thirty degrees of inclination above horizontal. The detector may be configured to permit the user to choose any angular orientation between 5 degrees above horizontal to 45 degrees above horizontal.

Upon detection of the movement of the comb 100 to the second predetermined angular orientation 180 by the tilt switch 120, the battery 110 is connected to the electromagnet 140 causing the magnet 150 to repulse the electromagnet 140 to extend or raise the comb 100 by a predetermined distance 190. The adjustment device is configured to permit the user to vary the determined distance 190. For example, this distance may be originally set at 0.375 inches, but the user may be able to increase or decrease this distance as desired. The user may be able to adjust the predetermined distance 190 over a wide range such as from a short distance, such as 1/32 of an inch, to the overall height of the comb 100. Various mechanisms may be used to permit the user to vary the predetermined distance 190. For example, the user may be able to decrease the current applied from the power source 110 to the electromagnet 140 decreasing the strength of the electromagnet field provided by the electromagnet 140. Another example for varying the predetermined distance 190 is limiting the distance that the electromagnet 140 may travel along the rod 145. The repulsion and thus, movement of the electromagnet 140 is shown for illustrative purposes only. For example, the electromagnet 140 may be connected directly to the stock 3 or to a base plate connected to the stock 3 and the magnet 150 may move away from the electromagnet 140 to raise the comb 100.

Figure 4:
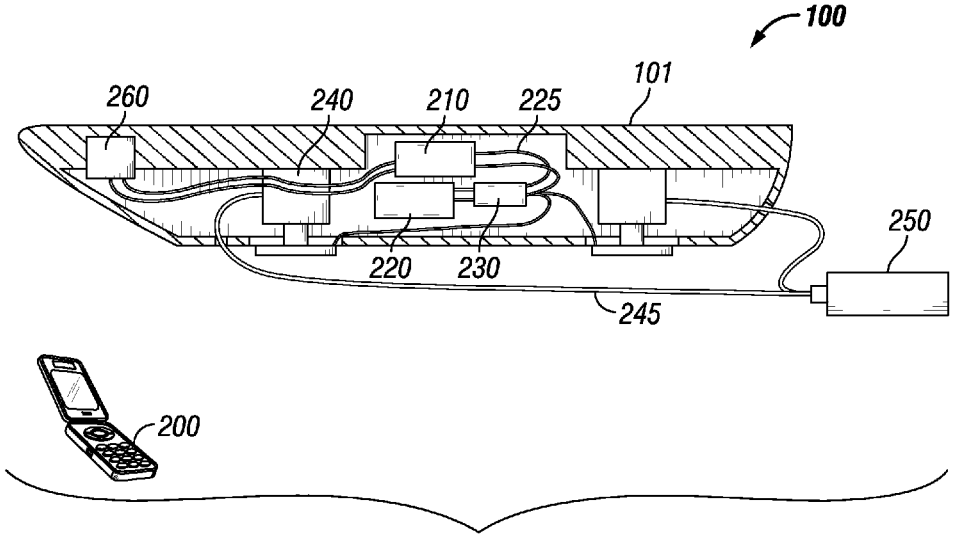
FIG. 4 shows an embodiment of an automatically adjusting comb.

FIG. 4 shows an embodiment of an automatically adjusting comb 100 that may be used to automatically raise a comb 100 on a firearm 1 when a detector detects that the firearm 1 and/or comb 100 has been raised to a predetermined angular orientation. The detector may be a processor 220 (such as a computer, special purpose integrated digital circuit, microprocessor, cpu, or the like) hereinafter, "computer", and a sensor such as an XYZ sensor 230. The computer 220 and/or XYZ sensor 230 may include software used to detect motion of the firearm 1 and/or comb 100, adjust the predetermined angular orientation, and/or adjust the predetermined distance that the comb 100 is extended. The computer 220 and the XYZ sensor 230 may be connected via wired connections 225 or may alternatively communicate with each other wirelessly. The computer 220 and the XYZ sensor 230 may be connected to a power source 210 via wired connections 225. Alternatively, the power source may be integral to the computer 220 and/or the XYZ sensor 230. The predetermined angular orientation may be set to be an angle, such as fifteen degrees, of inclination above a horizontal orientation. The user may be able to vary the predetermined angular orientation. The user may be able to use an interface 260, such as a dial or keypad, to adjust the predetermined angular orientation. The interface 260 may be connected to the computer 220 and/or XYZ sensor 230 via wired connections 225. Alternatively, the interface 260 may communicate wirelessly with the computer 220 and/or XYZ sensor 230. The user may also use a wireless device 200, such as a smart phone, PDA, or laptop, to communicate with the computer 220 and/or XYZ sensor 230 to vary the determined angular orientation.

As discussed above, the comb 100 includes an actuator to change the height of the top surface 101 of the comb 100 with respect to the stock 3 of a firearm 1. The actuator may be any mechanism that permits the comb 100 to be raised or extended with respect to the stock 3. The actuator may be an air cylinder 240 connected to an air source, such as a carbon dioxide cartridge 250 as shown in FIG. 4. Air cylinder 240 may be connected to an air source via air lines 245. Upon detection by the detector that the firearm 1 and/or comb 100 is at the predetermined angular orientation, the air cylinder 240 is connected to the air source 250 causing the movement of the air cylinder 240 extending the comb 100 a predetermined distance with respect to the stock 3. The user may be able to adjust the distance the air cylinder 240 moves when connected to the air source. For example, the user may use a wireless device 200 to communicate with the computer 220 to control the distance traveled by the air cylinder 240. Controlling the distance traveled by the air cylinder 240 permits the user to vary the predetermined distance that the comb 100 is extended by the actuator.

Figure 5:
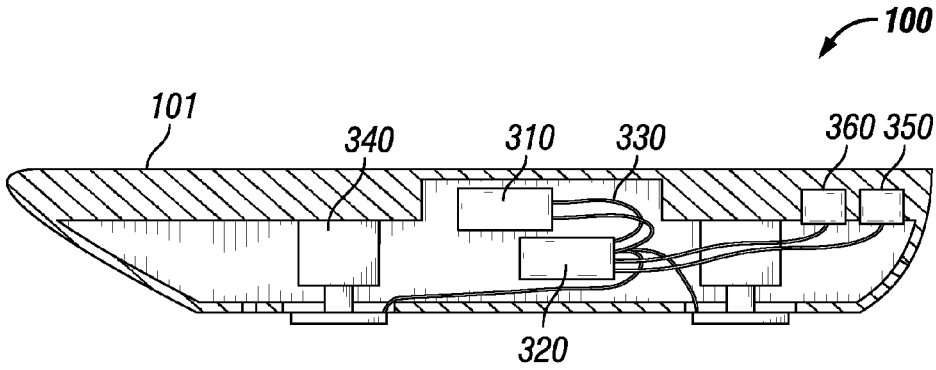
FIG. 5 shows an embodiment of an automatically adjusting comb.

FIG. 5 shows an embodiment of an automatically adjusting comb 100 that includes a detector and an actuator. The detector may be a motion sensor 320, such as an accelerometer, that detects the movement of the firearm 1 and/or comb 100 to a predetermined angular orientation. Upon detection of the comb at the predetermined angular orientation, an electric motor 340 is actuated to raise the surface 101 of the comb 100 to a predetermined distance above the top surface of the stock 3 of the firearm 1. The detection of the orientation of the comb 100 at the predetermined angular orientation by the motion sensor 320 may cause the electric motor 340 to be connected via wires 330 to a power source, such as a battery 310. Alternatively, the electric motor 340 may always be connected to a power source and the detection of the predetermined angular orientation may turn on or actuate the electric motor 340. The comb 100 may include an on/off switch 350. The on/off switch 350 when toggled to the off position prevents the automatic adjustment of the comb 100 even when the firearm 1 and/or comb 100 are positioned at a predetermined angular orientation. The on/off switch 350 may disable or deactivate the detector and/or the actuator. The comb 100 may also include a locking switch 360 that when enabled locks the automatic comb 100 in its current position. When the locking switch 360 is enabled, the adjustment device does not move the comb 100 regardless of the angular orientation of the firearm 1 and/or comb 100 or whether the firearm 1 is moved from a horizontal orientation to a predetermined angular orientation or is moved from the predetermined angular orientation back to a horizontal orientation.

Figure 6:
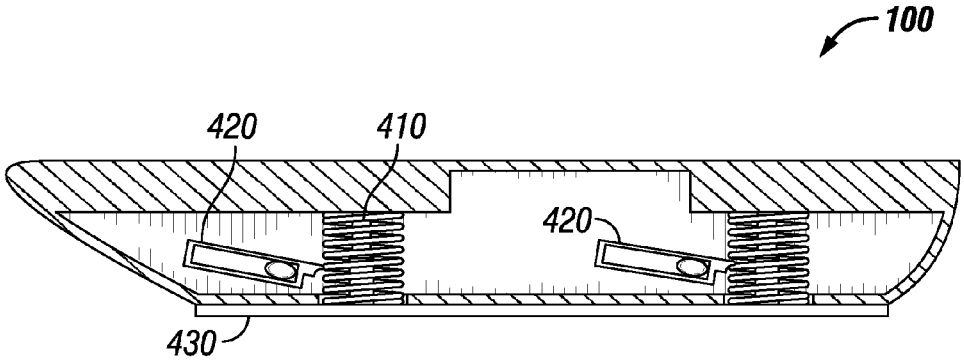
FIG. 6 shows an embodiment of an automatically adjusting comb.

One embodiment of the automatically adjusting comb 100 includes a mechanical actuator that may actuated by a mechanical sensor. A shown in FIG. 6, a mechanical actuator, such as a spring 410 may be connected to a base plate 430 attached to the bottom of the comb 100. Alternatively, the spring 410 may be connected directly to the stock 3. The spring 410 is initially held in a retracted or compressed position such that the top 101 of the comb 100 is flush or even with the top of the stock 3. The automatically adjusting comb 100 includes a mechanical detector, such as a tilt switch 420 that retains the spring 410 in the retracted position. Upon movement of the comb 100 from a horizontal orientation to a predetermined angular orientation, the tilt switch moves releasing the spring 410. The spring 410 extends raising the top 101 of the comb 100 to an elevated position. The tilt switch 420 may be adapted to retract the spring 410 upon returning the comb 100 to a horizontal position. Alternatively, the comb 100 may be manually pushed down to retract the spring 410 and retain the retracted spring 410 with the tilt switch 420 or other mechanical device.

Figure 7:
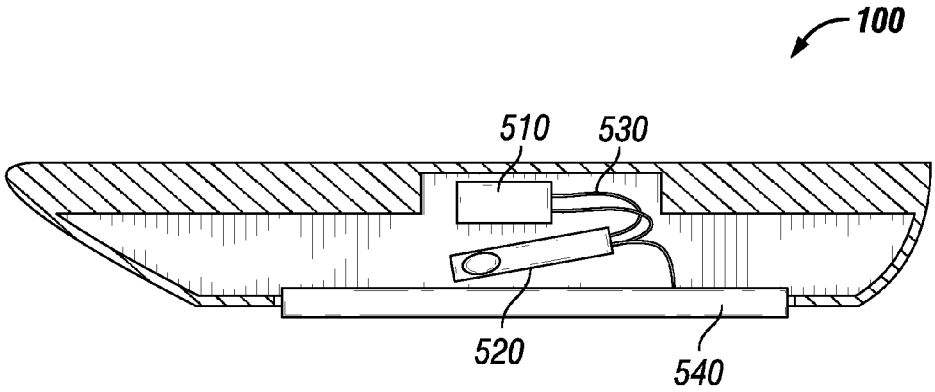
FIG. 7 shows an embodiment of an automatically adjusting comb.

FIG. 7 shows an embodiment of an automatically adjusting comb 100 that includes a piezoelectric transducer 540 selectively connected to a power source 510 via connections 530. The comb 100 includes a detector 520 that detects the movement of the firearm 1 and/or comb 100 to a predetermined angular orientation. Upon detecting the predetermined angular orientation, the detector 520 causes the piezoelectric transducer 540 to be connected to the power source 510 upon which the transducer 540 expands raising the top 101 of the comb 100 by a predetermined distance above the top of the stock 3. The predetermined distance may be varied by a user by varying the current applied to the piezoelectric transducer 540 from the power source 510.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

TABLE OF REFERENCE NUMERALS FOR FIGS. 1-7

| | |
|---|---|
| 1 | firearm |
| 2 | forend |
| 3 | butt stock |
| 4 | grip |
| 5 | thumbhole |
| 100 | automatic comb |
| 101 | top surface of automatic comb |
| 110 | power source |
| 120 | tilt switch |
| 130 | connecting wires |
| 140 | electromagnet |
| 145 | connecting post |
| 150 | magnet |
| 160 | first predetermined angular orientation |
| 170 | central axis of comb |
| 180 | second predetermined angular orientation |
| 190 | predetermined adjustment distance |
| 200 | wireless device |
| 210 | power source |
| 220 | computer |
| 225 | connecting wires |
| 230 | xyz sensor |
| 240 | air cylinder |
| 245 | air hose |
| 250 | air source |
| 260 | interface |
| 310 | power source |
| 320 | motion sensor |
| 330 | connecting wires |
| 340 | motor |
| 350 | on/off switch |
| 360 | locking switch |
| 410 | mechanical actuator/spring |
| 420 | mechanical detector/tilt switch |
| 430 | base plate |
| 510 | power source |

-continued

TABLE OF REFERENCE NUMERALS FOR FIGS. 1-7

| | |
|---|---|
| 520 | detector |
| 530 | electrical connections |
| 540 | piezoelectric transducer |

What is claimed is:

1. An accessory for a firearm, the accessory comprising:

a comb configured to be attached to a portion of a firearm, the comb configured to be extended a predetermined distance from an initial position while attached to the portion of the firearm;

the comb configured to automatically extend the predetermined distance from the initial position when the comb moves from a first angular orientation to a second angular orientation;

a detector configured to detect an angular orientation of the comb; and an actuator connected to the comb and being in communication with the detector, wherein upon detection of movement of the comb to the second angular orientation by the detector the actuator is actuated extending the comb the predetermined distance.

2. The accessory of claim 1, wherein the first angular orientation is a horizontal angular orientation and the second angular orientation is at least fifteen degrees inclined above the horizontal orientation.

3. The accessory of claim 1, wherein the detector is a tilt switch, a motion sensor, or a computer connected to a control sensor.

4. The accessory of claim 1, wherein the detector is configured to detect when the comb is at the second angular orientation, the second orientation being a predetermined inclination above the first angular orientation.

5. The accessory of claim 4, wherein the predetermined inclination is at least fifteen degrees.

6. The accessory of claim 4, wherein the predetermined inclination is adjustable.

7. The accessory of claim 1, wherein the predetermined distance is 0.375 inches.

8. The accessory of claim 1, wherein the predetermined distance is adjustable.

9. The accessory of claim 1, wherein the actuator comprises one of the following systems:

an earth magnet, an electromagnet, and a power source, wherein detection of the second angular orientation connects the power source to the electromagnet causing a repulsion between the earth magnet and the electromagnet to extend the comb the predetermined distance;

a pneumatic air cylinder and an air supply, wherein detection of the second angular orientation connects the air source to the pneumatic air cylinder to extend the comb the predetermined distance;

an electric motor and a power source, wherein detection of the second angular orientation connects the power source to the electric motor to actuate the motor to extend the comb to the predetermined distance;

a piezoeletric transducer and a power source, wherein detection of the second angular orientation connects the powers source to the piezoelectric transducer to extend the comb the predetermined distance; and a biased spring and a latch, wherein detection of the second angular orientation actuates the latch to release the biased spring to extend the comb the predetermined distance.

10. The accessory of claim 1, wherein the detector is configured to detect that the angular orientation of the comb has moved from the second angular orientation to the first angular orientation and the actuator is configured to retract the comb the predetermined distance based on the detector detecting that the angular orientation of the comb has moved from the second angular orientation to the first angular orientation.

* * * * *